US007891029B2

(12) United States Patent
Mosler et al.

(10) Patent No.: US 7,891,029 B2
(45) Date of Patent: Feb. 22, 2011

(54) BEDPAN

(75) Inventors: Theodore J. Mosler, Raleigh, NC (US); Scott P. Jarnagin, Raleigh, NC (US); Todd M. Korogi, Mebane, NC (US); Andrew J. DiMeo, Sr., Raleigh, NC (US)

(73) Assignee: Medline Industries, Inc., Mundelein, IL (US)

( * ) Notice: Subject to any disclaimer, the term of this patent is extended or adjusted under 35 U.S.C. 154(b) by 1066 days.

(21) Appl. No.: 11/416,981

(22) Filed: May 3, 2006

(65) Prior Publication Data

US 2006/0253968 A1 Nov. 16, 2006

Related U.S. Application Data

(60) Provisional application No. 60/681,184, filed on May 14, 2005.

(51) Int. Cl.
*A61G 9/00* (2006.01)

(52) U.S. Cl. ..... 4/450; 4/456

(58) Field of Classification Search ..... 4/456, 4/450, 457; 220/555, 527
See application file for complete search history.

(56) References Cited

U.S. PATENT DOCUMENTS

| | | | | | |
|---|---|---|---|---|---|
| 1,181,001 | A | * | 4/1916 | Griesel | 4/450 |
| 1,252,868 | A | * | 1/1918 | Erickson | 4/450 |
| 1,445,836 | A | * | 2/1923 | Kowalsky | 4/450 |
| 1,918,083 | A | * | 7/1933 | Coles et al. | 4/450 |
| 1,998,061 | A | * | 4/1935 | Wachs | 4/450 |
| 3,453,664 | A | | 7/1969 | Gilbert | 4/112 |
| 3,597,771 | A | | 8/1971 | Rickmeier, Jr. | 4/112 |
| 3,877,083 | A | * | 4/1975 | Howe | 4/449 |
| 3,927,426 | A | * | 12/1975 | Geddes | 4/144.3 |
| 3,992,729 | A | * | 11/1976 | Mills | 4/450 |
| 4,048,682 | A | | 9/1977 | Smith | 5/91 |
| 4,343,400 | A | * | 8/1982 | Faucillon | 206/507 |
| 4,368,548 | A | | 1/1983 | Glass | 4/451 |
| 5,079,788 | A | | 1/1992 | Raupp | 4/450 |
| 5,136,733 | A | | 8/1992 | Church | 4/456 |
| 5,203,467 | A | * | 4/1993 | Tucker | 220/254.3 |
| 5,511,279 | A | * | 4/1996 | Ippolito | 15/257.06 |
| 5,778,461 | A | * | 7/1998 | Attaway | 4/454 |
| 5,819,334 | A | | 10/1998 | Maze | 4/450 |
| 5,867,845 | A | | 2/1999 | Fangmann | 4/456 |
| 6,532,604 | B2 | | 3/2003 | Moser | 4/450 |
| 2002/0004949 | A1 | | 1/2002 | Spitzer | 4/451 |

* cited by examiner

*Primary Examiner*—Khoa D Huynh
*Assistant Examiner*—Karen Younkins
(74) *Attorney, Agent, or Firm*—Nixon Peabody LLP

(57) ABSTRACT

A bedpan for collecting waste includes a seating area and a plurality of cavities. The seating area is located in a main body of the bedpan. The plurality of cavities is formed within the seating area and includes a first cavity for collecting liquid waste and a second cavity for collecting solid waste. The first cavity and the second cavity are separated by a divider.

5 Claims, 7 Drawing Sheets

Fig. 2
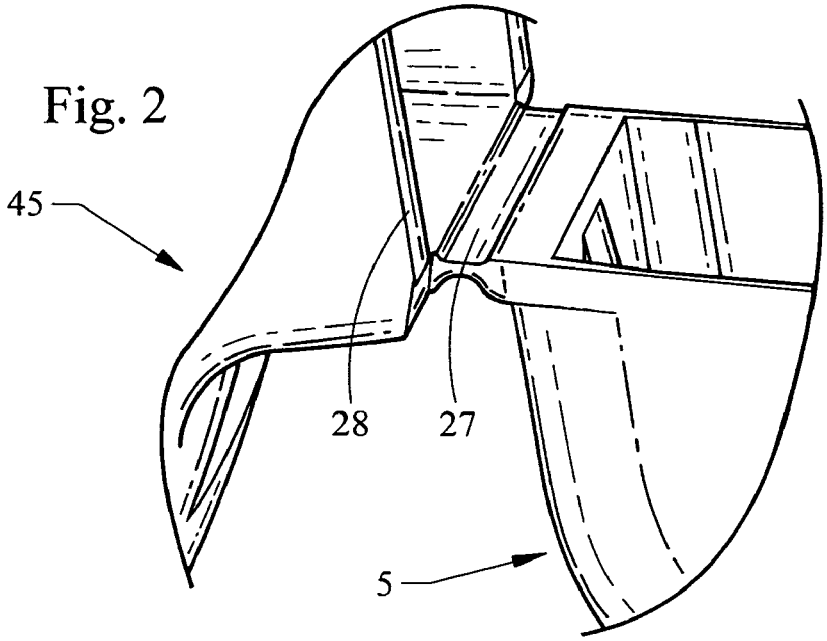
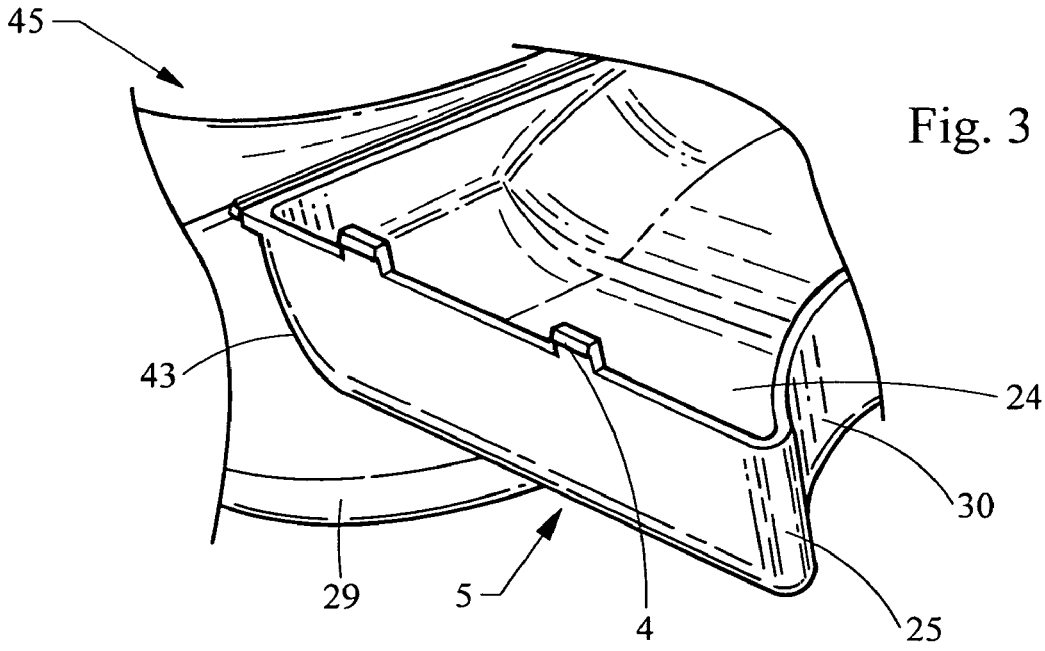
Fig. 3

BEDPAN

CROSS-REFERENCE TO RELATED APPLICATION

This application claims the benefit of U.S. Provisional Application No. 60/681,184, filed May 14, 2005, which is hereby incorporated by reference in its entirety.

FIELD OF THE INVENTION

The present invention relates generally to bedpans and, more particularly, to a bedpan for receiving liquid and solid waste in separate compartments.

BACKGROUND OF THE INVENTION

Originally, bedpans were manufactured using metal materials. Metal bedpans, however, include numerous disadvantages in comparison to plastic bedpans. For example, metal bedpans are expensive to manufacture, are uncomfortable to use, and are difficult to clean. Metal bedpans are uncomfortable because they are cold and hard to the touch of a user. Eventually, the industry began manufacturing plastic bedpans using a relatively inexpensive plastic material, e.g., high-density polyethylene ("HDPE") or polypropylene ("PP"). Some advantages of using plastic material are a lower manufacturing cost, a single-use per patient, and more comfort for the user (e.g., plastic is warmer to the touch of the user).

Current plastic bedpans include numerous problems. Some current bedpans cannot be used for both liquid and solid waste. While some current bedpans can receive both liquid and solid waste, these bedpans are impractical because the liquid and solid waste are received in a single compartment. Thus, an attendant must separate the liquid waste from the solid waste when it is necessary to measure the volume of the liquid waste. One problem associated with these bedpans is that the attendant must pour the liquid waste into a graduated cylinder without also pouring the solid waste. Another problem associated with these bedpans is that the attendant must use an additional container, e.g., the graduated cylinder, to measure the liquid waste.

Other bedpans have thin sides, which increase the affinity for bedsores from pressure distribution. Consequently, pressure ulcers are common in users of current plastic bedpans. Some current bedpans attempt to solve this problem by coupling a cushioning device to the bedpan to alleviate some discomfort. However, the cushioning device includes corners that may cause discomfort during use. Further, the cushioning device may be improperly attached to the bedpan, resulting in improper use of the bedpan, and may absorb liquid waste, resulting in wetting the user and, consequently, leading to ulcer formation.

Another problem associated with some bedpans is that they do not include both a splashguard and a stacking capability. The bedpans that lack a splashguard are more difficult to clean than bedpans with a splashguard. Some bedpans that include a splashguard have a sharp edge near the location where the user contacts the bedpan. The sharp edge causes the user discomfort and increased susceptibility to bedsores.

The bedpans that are not stackable have higher manufacturing and shipping costs and require increased storage space. Although some current bedpans are stackable, the bedpans are at most partially nested. For example, the bedpans are stacked on top of each other such that only a part of one bedpan is located within a portion of another bedpan. In another example, no portion of the bedpan is located within any portion of another bedpan. Other current bedpans that are capable of being stacked fully nested are problematic because they have sharp edges that contribute to ulcer formation.

Yet another problem associated with some bedpans relates to their opaque characteristics. When determining the volume output of a user, an attendant (e.g., a nurse) pours liquid waste into a graduated cylinder. Because the attendant cannot see the contents of an opaque bedpan, the attendant cannot readily determine whether any waste has been deposited in the opaque bedpan. Consequently, in some cases the attendant uses his or her hands to hold back solid waste when pouring the liquid waste into the graduated cylinder.

Further, the opaque characteristics of some bedpans prevents the attendant from readily determining when the bedpan should be emptied. Because the attendant cannot readily view the contents of the bedpan to determine whether the bedpan should be emptied, the user may sit on the bedpan for extended periods of time. These extended periods of time generally increase the likelihood of bedsores formation.

Thus, there is a need to provide a bedpan having a comfortable user surface that reduces the likelihood of bedsores formation. The increased comfort will generally decrease the pain and suffering of a user such as a patient in a hospital.

Another need is directed to providing a bedpan having both a splashguard and a stacking capability. The splashguard decreases the attendant's maintenance duties, such as cleaning the user (e.g., a hospital patient) and the user's bed sheets. The stacking capability decreases manufacturing cost and storage space.

Yet another need is directed to separating the liquid waste and the solid waste. One advantage of separating the liquid waste and the solid waste is that it increases efficiency when measurements of the liquid waste are necessary. Another advantage of separating the liquid waste and the solid waste is that it allows the attendant to make more accurate measurements of the liquid waste volume.

Yet another need is directed to providing a bedpan that enables the attendant to readily determine when the bedpan should be emptied and the amount of liquid waste. Emptying the bedpan as soon as the user has finished using it will generally decrease the likelihood of the formation of bedsores. Further, work efficiency will increase if the attendant is able to readily determine the amount of liquid waste. The present invention is directed to satisfying one or more of these needs and/or to solving other problems.

SUMMARY OF THE INVENTION

A bedpan for collecting waste includes a seating area and a plurality of cavities. The seating area is located in a main body of the bedpan. The plurality of cavities is formed within the seating area and includes a first cavity for collecting liquid waste and a second cavity for collecting solid waste. The first cavity and the second cavity are separated by a divider.

In another aspect of the present invention, a bedpan for collecting waste includes a main body and a living hinge. The main body collects liquid waste and solid waste and includes a seating area and two cavities. The two cavities, which include a first cavity and a second cavity, are formed within the seating area. The first cavity receives the liquid waste and the second cavity receives the solid waste. The living hinge is rotatably connected to the main body for rotating between a closed position and an open position. The living hinge protects a user from splashing in the closed position and allows stacking of the bedpan in the open position.

In an alternative aspect of the present invention, a stackable bedpan for collecting waste includes a main body for collecting liquid waste and solid waste and a living hinge that is rotatably connected to the main body. The main body is made from a translucent thermoplastic material and includes a plurality of cavities and at least one slit. The plurality of cavities includes a first cavity for collecting the liquid waste and a second cavity for collecting the solid waste. The first cavity and the second cavity are separated by a divider. The slit is located near a rear end of the main body. The living hinge rotates between a closed position and an open position. In the closed position, the living hinge protects a user from liquid waste splashing and, in the open position, the living hinge allows stacking of the bedpan. The living hinge includes a top side, which has a curved shape to provide a comfortable seating area, and an underside, which is shaped to accommodate a second living hinge of a second bedpan when the bedpan and the second bedpan are stacked. The living hinge further includes at least one locking element for securing the living hinge to the main body in the closed position, the locking element being snapped into the at least one slit.

The above summary of the present invention is not intended to represent each embodiment or every aspect of the present invention. The detailed description and Figures will describe many of the embodiments and aspects of the present invention.

BRIEF DESCRIPTION OF THE FIGURES

The foregoing and other advantages of the invention will become apparent upon reading the following detailed description and upon reference to the drawings.

FIG. 2 is an enlarged view showing a living hinge of the bedpan of FIG. 1 in an open position.

FIG. 3 is an enlarged view showing a plurality of locking elements of the bedpan of FIG. 1.

Figure 1:
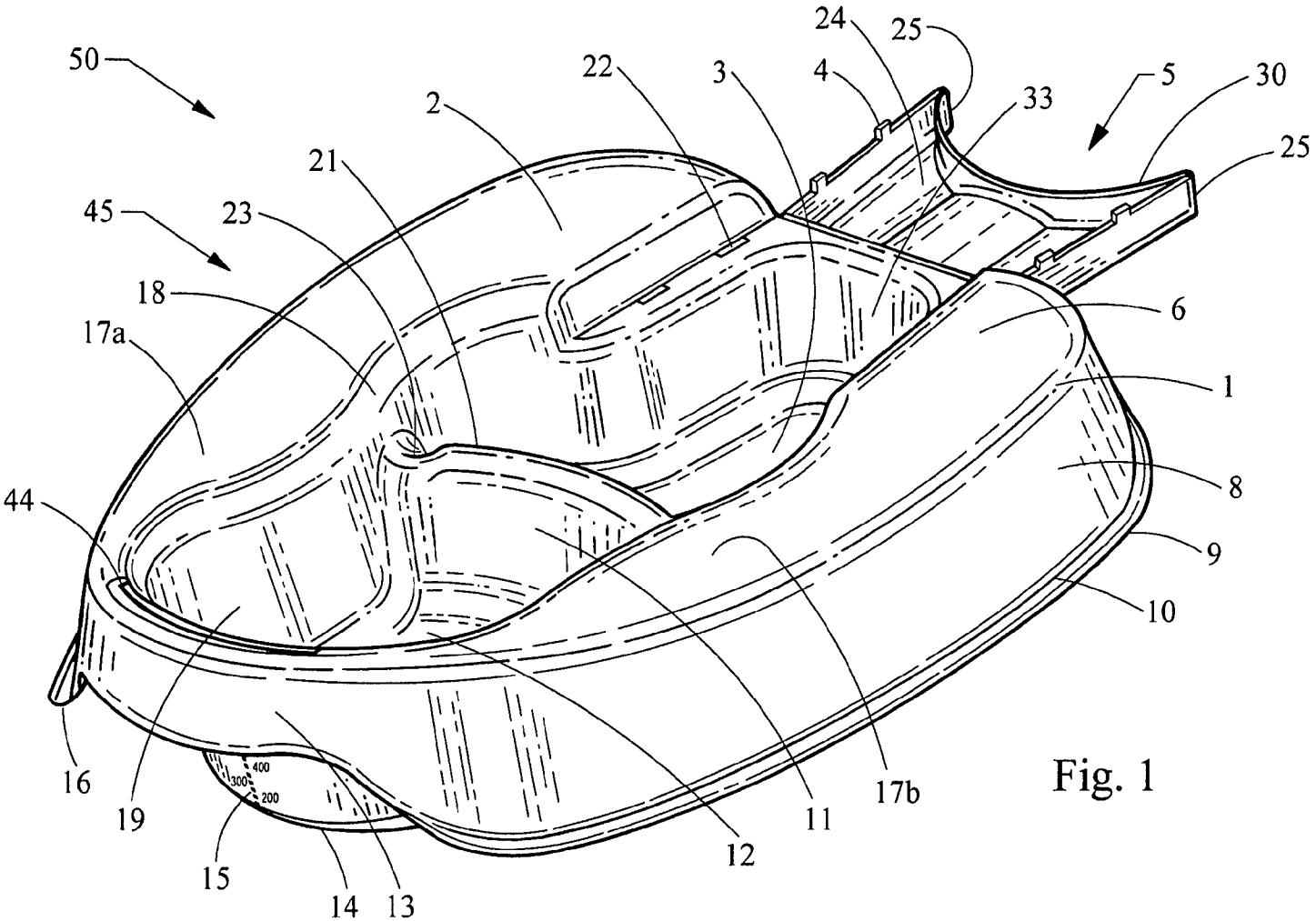
FIG. 1 is a perspective top view of a bedpan according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention.

DESCRIPTION OF ILLUSTRATIVE EMBODIMENTS

Referring to FIG. 1, a bedpan 50 includes a main body 45 and a living hinge 5. The main body 45 includes a top-left side 2 and a top-right side 6 (also referred to as "top sides 2, 6") that form a general u-shape and that are ergonomically designed in a slightly concave shape. For example, the top sides 2, 6 include rounded edges to increase comfort to a user of the bedpan 50. Further, the two top sides 2, 6 are wide enough to aid in pressure distribution and decrease the likelihood of bedsore formation. In general, the top sides 2, 6 provide a seating area for the user.

A primary wing or flange 8 is connected near its top edge to a corresponding one of the top sides 2, 6. The primary wing 8 is further connected near its bottom edge to a generally flat area 10, which in turn is connected to a secondary wing or flange 9. The primary wing 8 is shaped to allow stacking and nesting of the bedpan 50 within another bedpan 50. For example, for stacking and/or nesting purposes, the primary wing 8 is inclined such that the top edge of the primary wing 8 is located closer to the center of the main body 45 than the bottom edge of the primary wing 8. Thus, when stacking bedpans 50, the angled shape of the primary wing 8 permits the bedpan 50 to slide within the other bedpan 50.

The generally flat area 10 includes a bottom surface that makes contact with a bed and, more specifically, with bed sheets. The bottom surface of the generally flat area 10 slides across the bed sheets when the bedpan 50 is moved, such as when the bedpan 50 requires changing. To prevent snagging, which can produce spillage of liquid waste, the bottom surface of the generally flat area 10 is a generally smooth surface.

The bedpan 50 rests on a rounded base 14. The secondary wing 9 is located toward the bottom of the bedpan 50 and terminates in a corner 16. The secondary wing 9 and the corner 16 are curved upwards relative to and, together with the rounded base 14, allow easy transition of the bedpan 50 while the bedpan 50 slides across a bed. Thus, the secondary wing 9, the rounded base 14, and the corner 16 are shaped to prevent snagging of the bedpan 50 on the bed sheets.

The main body 45 further includes a front-left end 17*a*, which includes a front portion of the top-left side 2, a front-right end 17*b*, which includes a front portion of the top-right side 6, and a ridge 44. To minimize or prevent splashing of liquid waste, the front-left end 17*a* and the front-right end 17*b* are each slightly inclined upwards relative to the top-left side 2 and the top-right side 6. Thus, the front-left end 17*a* and the front-right end 17*b* act as a splashguard for the liquid waste. The ridge 44 connects the front-left end 17*a* and the front-fight end 17*b* and is separated from the walls of a first cavity 12 by a gap, or open area. The gap allows a user of the bedpan 50 to grip the ridge 44 when it is necessary to pull or push the bedpan 50 to a desired location.

The main body 45 also includes the first cavity 12 and a second cavity 3, which are separated by a divider 21. The first cavity 12 is adapted to receive liquid waste and the second cavity 3 is adapted to receive solid waste. Thus, the divider 21 is adapted to generally separate the solid waste and the liquid waste.

The first cavity 12 includes a front wall 19, which is located near the front-left end 17*a* and the front-right end 17*b* of the main body 45. The front wall 19 is adapted to receive at least a portion of another bedpan 50 when stacked. Further, the first cavity 12 includes at least one and generally a plurality of graduations 15 for measuring the volume of the liquid waste. The graduation(s) 15 eliminate the need to pour the liquid waste from the bedpan 50 into another container, such as a graduated cylinder, for measurement purposes.

The second cavity 3 includes a rear wall 33 that is adapted to receive at least a portion of another bedpan 50 when stacked. At least one and generally a plurality of slits 22 are provided near or at the top of the second cavity 3 for receiving corresponding ones of the locking element(s) 4, which are described below in more detail.

The divider 21, which includes a front face 11, is positioned generally vertically relative to the rounded base 14 and is used to confine the liquids to the first cavity 12 and away from the second cavity 3. The divider 21 further includes two notches 23, each of the two notches 23 being positioned near the intersection of the divider 21 and the main body 45 of the bedpan 50. The notches 23 are located at the top of the divider 21. The notches 23 are adapted to minimize or eliminate splashing when redirection of liquid from the second cavity 3 to the first cavity 12 is necessary. For example, if liquid has accidentally been placed in the second cavity 3, a user or attendant can tilt the bedpan 50 at a sufficient angle to permit the liquid to flow from the second cavity 3 into the first cavity 12. During the redirection of the liquid, the central section of the divider 21 (which is located generally between the notches 23) prevents solid waste from moving from the second cavity 3 to the first cavity 12. Alternatively, any number of notches 23 may be used at any location in the divider 21. For example, the notches 23 may be located at the bottom of the divider 21.

A front section 13 of the main body 45 is located near the front of the first cavity 12. The front section 13 may be used as a handle by an attendant, such as a nurse, for holding the bedpan 50 when it is necessary to move or change the bedpan 50 or to measure the liquid waste. The front section 13 includes the ridge 44 that is designed to provide extra gripping support.

An outer edge 1 (which connects the top sides 2, 6 to the primary wing 8) and an inner edge 18 (which connects the top sides 2, 6 to the front wall 19) wrap around the main body 45 of the bedpan 50 to provide a curved, soft edge. Thus, the outer and inner edges 1, 18 produce a comfortable seating edge for a user of the bedpan 50.

Figure 9:
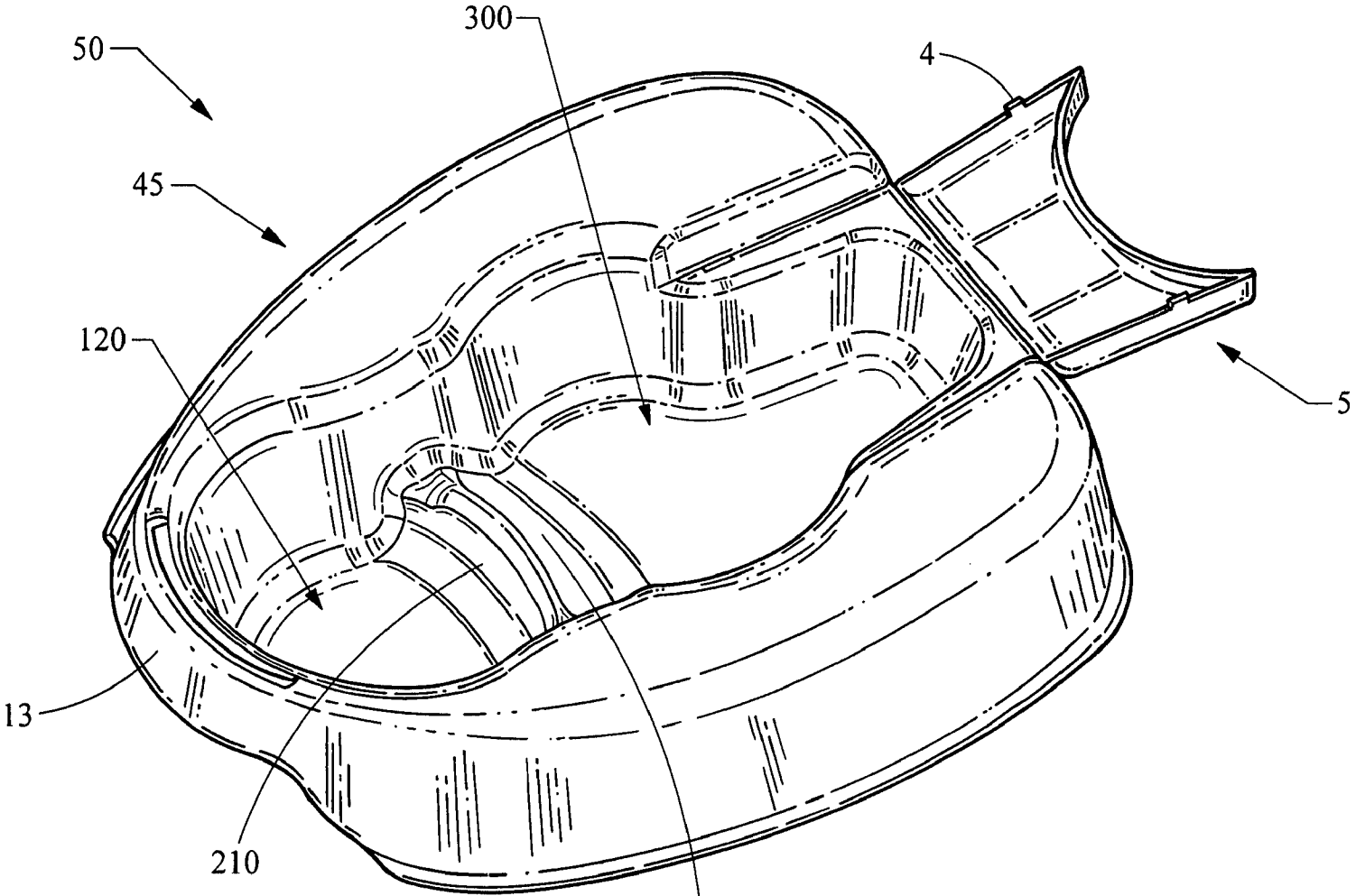
FIG. 9 is a perspective top view of a bedpan according to an alternative embodiment of the present invention.

The living hinge 5, which is shown in an open position, includes the locking element(s) 4 (also referred to as snaps), an underside 24, and a curved portion 30. In the embodiment depicted, the plurality of locking elements 4 includes two pairs of locking elements located on opposing sides of the living hinge 5. Optionally, any number of locking elements 4 or pairs of locking elements 4 are used. For example, as shown in FIG. 9, a single locking element 4 may be sufficient for securing the living hinge 5 into the closed position.

The living hinge 5 has two positions, the open position and a closed position. In the closed position (shown more clearly in FIG. 7), the slits 22 are adapted to receive, correspondingly, the locking element(s) 4. After closing the living hinge 5, it may be reopened for easy cleaning.

The curved portion 30 includes two ends 25 and is located at an end of the living hinge 5. The curved portion 30 is designed to allow for a wider opening at a top surface when the living hinge 5 is in a closed position (shown more clearly in FIG. 7).

The underside 24 is manufactured to provide the bedpan 50 with a stackable feature, wherein a plurality of bedpans 50 can be stacked to minimize storage space. At a minimum, the living hinge 5 of a first bedpan 50 will not interfere with the living hinge 5 of a second bedpan 50 when the second bedpan 50 is stacked on top of the first bedpan 50. Optionally, the living hinge 5 of the first bedpan 50 may accommodate in its respective underside 24 at least a portion of the living hinge 5 of the second bedpan 50.

Referring to FIG. 2, the living hinge 5 includes at least one hinge 27 that is connected to a back end 28 of the main body 45. The living hinge 5 rotates around an axis of the hinge 27 to change between the open position and the closed position.

Referring to FIG. 3, the curved portion 30 includes ends 25 (only one end 25 is shown) that are rounded to provide increased comfort to the user. A back end 43 of the living hinge 5 is also rounded to provide increased comfort to the user. Thus, when a user sits on the bedpan 50, the rounded shape of the ends 25 and the back end 43 of the living hinge 5 increases the comfort level for the user.

The main body 45 further includes a bottom back edge 29. To prevent snagging of the bedpan 50 on the bed sheets, the bottom back edge 29 is rounded for ease of gliding along the surface of the bed.

Figure 4:
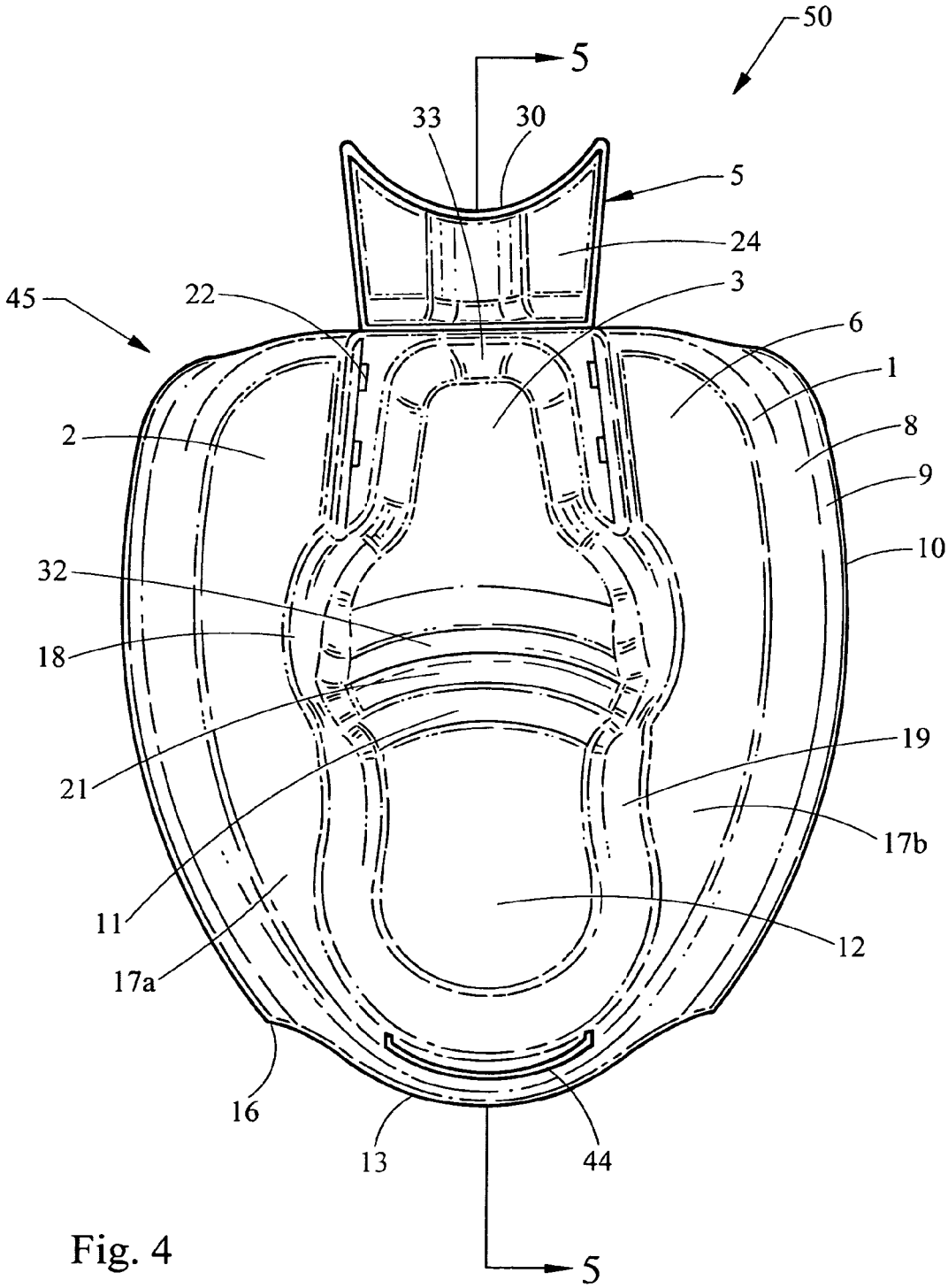
FIG. 4 is a top view of the bedpan of FIG. 1.

Referring to FIG. 4, the divider 21 includes an inclined side 32. According to the shown embodiment, a top edge of the inclined side 32 is angled toward the second cavity 3.

Figure 5:
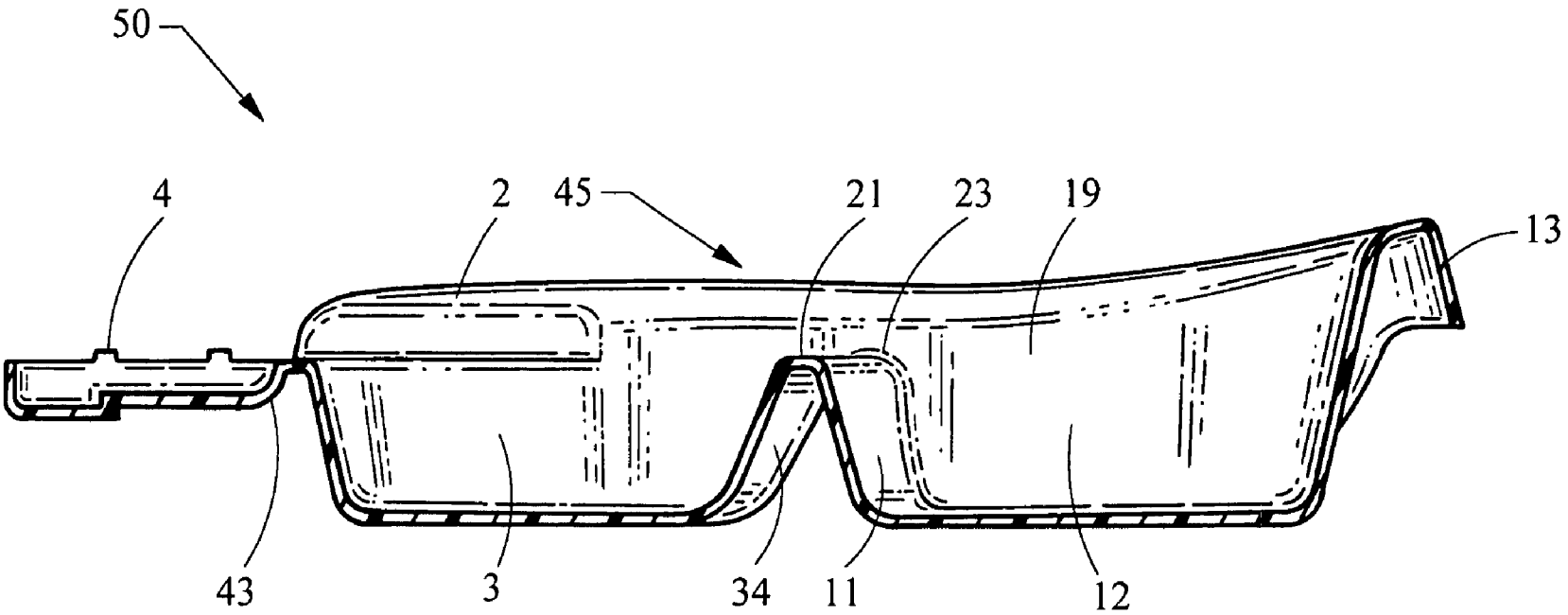
FIG. 5 is a sectional view taken along line 5-5 of FIG. 4.

Referring to FIG. 5, the divider 21 is represented having an incline 34 and a drop-off 11. The incline 34 and the drop-off 11 are inclined toward each other, and are connected via a middle section of the divider 21. The incline 34 slopes from the middle section of the divider 21 towards the first cavity 12, and the drop-off 11 slopes from the middle section of the divider 21 towards the second cavity 3. The slope angle of the incline 34 and the drop-off 11 can be different, can be the same, and/or can be directed towards either the first cavity 12 or the second cavity 3. For example, in an alternative embodiment (not shown) the middle section of the divider 21 is located closer towards the second cavity 3 than the embodiment depicted in FIG. 5 and the drop-off 11 is positioned parallel to the incline 34, wherein both the incline 34 and the drop-off 11 are sloped towards the first cavity 12.

Figure 6:
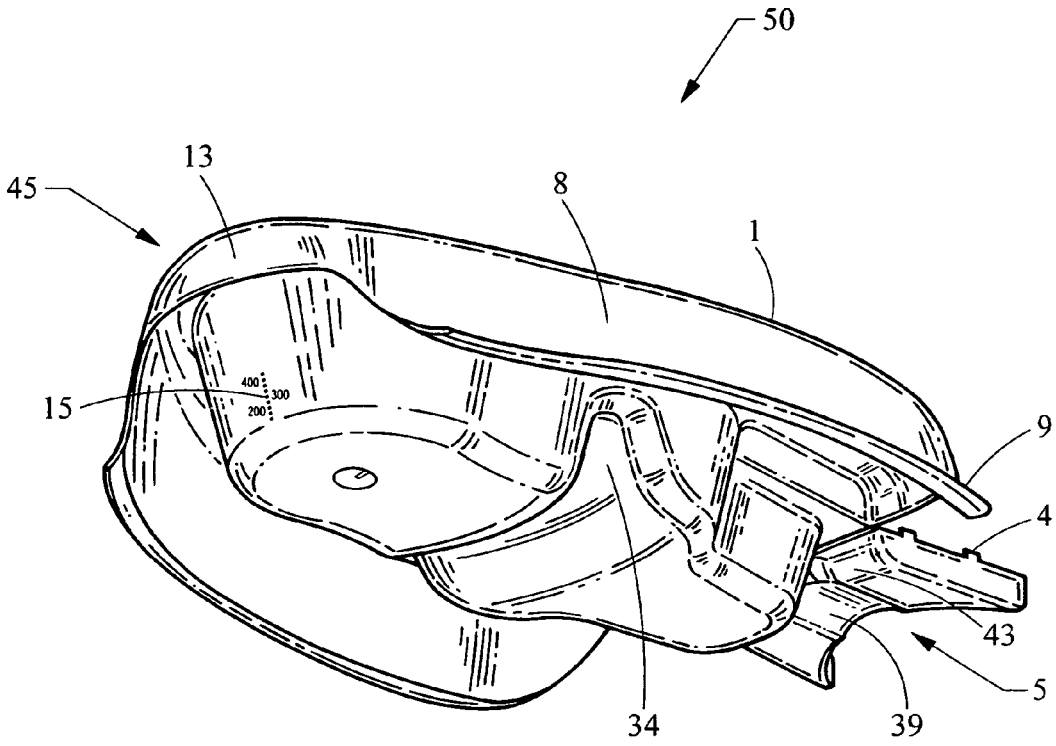
FIG. 6 is a perspective bottom view of the bedpan of FIG. 1.

Referring to FIG. 6, the living hinge 5 includes an indentation 39 that is located in a central bottom portion of the living hinge 5. The indentation 39 is also known as a tailbone scoop and relieves pressure exerted against the user's tailbone. The pressure exerted against the user's tailbone is a common source of pressure ulcers in users, especially in users that have been sitting on the bedpan 50 for extended periods of time.

Figure 7:
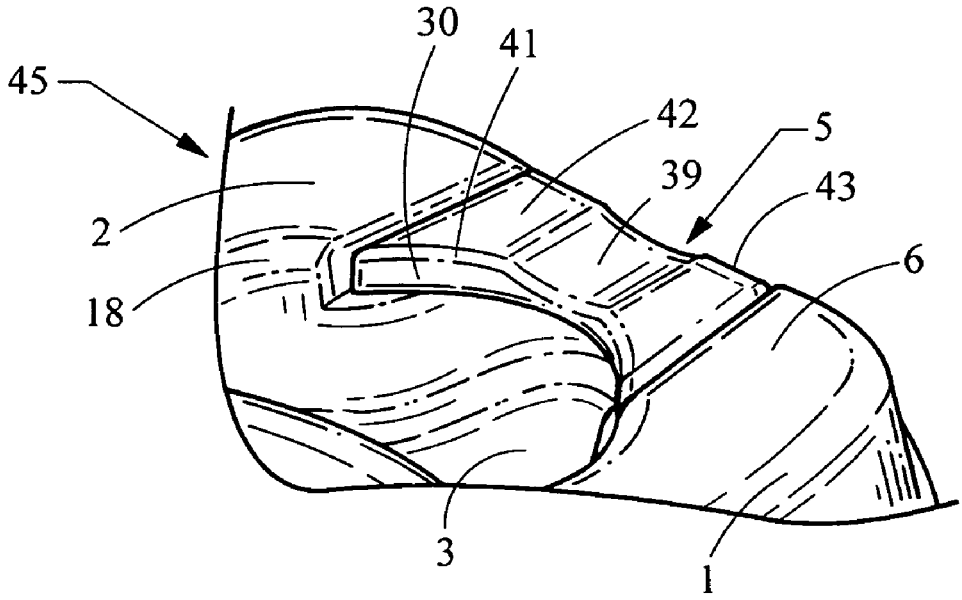
FIG. 7 is an enlarged view showing the living hinge of the bedpan of FIG. 1 in a closed position.

Referring to FIG. 7, the living hinge 5 is shown in the closed position. As shown, the curved portion 30 is angled such that an opening is provided that is wider at a top edge of the curved portion 30 than at a bottom edge of the curved portion 30. An inner edge 41 of the living hinge 5 is curved downward to prevent the user from contacting any sharp edges. A top side 42 of the living hinge 5 is generally concavely shaped similar to the top sides 2, 6 of the main body 45 to provide a comfortable seating arrangement.

Figure 8A:
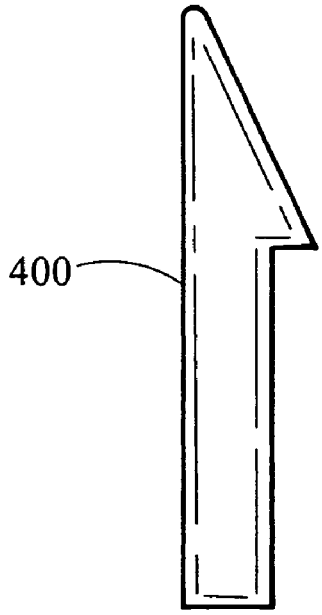
FIG. 8*a* is a side view showing a locking element according to an alternative embodiment of the present invention.

Referring to FIG. 8*a*, locking element(s) other than the locking element(s) 4 described above in reference to FIG. 1 may be used. For example, a locking element 400 is provided according to an alternative embodiment of the present invention. The locking element 400 is designed to snap into a corresponding slit such that the living hinge 5 remains in the closed position. Specifically, the locking element 400 is designed as a permanent snapping element.

Figure 8B:
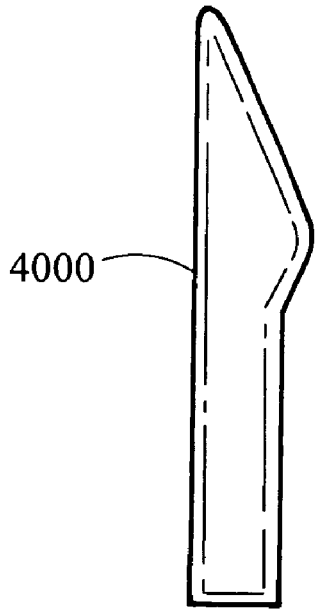
FIG. 8*b* is a side view showing a locking element according to another alternative embodiment of the present invention.

Referring to FIG. 8*b*, a locking element 4000 is provided according to another alternative embodiment of the present invention. The locking element 4000 is designed to snap into a corresponding slit such that the living hinge 5 remains snapped temporarily into the closed position. Specifically, the locking element 4000 is designed to be a temporary snapping element. Using such a locking element, for example, the living hinge 5 may be reopened periodically for easy cleaning.

Referring to FIG. 9, a divider 210 having an inclined side 320 is shown in accordance with an alternative embodiment of the present invention. The divider 210 is located closer to the front section 13 of the bedpan 50, in comparison to the divider 21 described in reference to FIGS. 1-8*b*. The graduation(s) 15 (not shown) are located closer together and, consequently, it is easier to differentiate between various volume levels. Because the divider 210 is closer to the front of the bedpan 50, the overall fluid capacity is decreased as the first cavity 120 in this embodiment is smaller than the first cavity 12 of the embodiments described in reference to FIGS. 1-8*b*.

The inclined side 320 of the embodiment represented in FIG. 9 includes a more gradual angle than the inclined side 32 of the embodiments described in reference to FIGS. 1-8*b* (wherein the inclined side 32 is positioned generally vertically). The more gradual angle allows the bedpan 50 to be tipped at a smaller angle, in comparison to the embodiments described in reference with FIGS. 1-8*b* when draining fluid from a second cavity 300.

The living hinge 5 provides several advantages, including easy manufacturing, stackable capability, splash protection, comfortable seating, easy measuring of the fluid waste deposited in the bedpan 50, and easy cleaning. The bedpan 50 may be manufactured using a variety of materials including, but not limited to, injection molded clarified polypropylene (PP), high-density polyethylene (HDPE), other polyolefin(s), and/or similar thermoplastic material(s) that produce a translucent, transparent, or generally translucent and/or transparent bedpan 50. In addition, combinations of these materials may be used to allow the attendant to easily measure liquid waste present in the first cavity 12, 120. The attendant can readily measure the liquid waste using the graduation(s) 15. Further, the use of translucent and/or transparent material(s) allows the attendant to quickly determine whether the bedpan 50 has been soiled and, therefore, whether the bedpan 50 should be changed.

The bedpan 50 can be manufactured using a molding process, wherein no undercuts are necessary. When the living hinge 5 is in the open position, the bedpan 50 can be stacked upon another bedpan 50. When the living hinge 5 is in the closed position, it functions as a splashguard for protecting the user and/or the attendant. Because no undercutting is necessary, the living hinge 5 has generally curved and smooth edges that provide a more comfortable seating position. The comfortable seating position helps to greatly reduce the number of bedsores for the user. In addition, the attendant can easily open the living hinge 5 for easy and thorough cleaning of the bedpan 50 in between uses.

Several of the advantages described above are achieved using the divider 21, 210. For example, easy measuring of the fluid waste is achieved using the divider 21, 210. By separating the solid and liquid waste, the attendant can accurately measure the liquid waste. The middle section of the divider 21, 210 acts as a solid waste barrier while the liquid waste can easily flow over the notches 23 on either side of the divider 21, 210. In another example, the divider 21, 210 can act as a splashguard.

Other advantages of the current invention are provided by the graduation(s) 15, which are included on the liquid side of the bedpan 50. For example, the graduation(s) 15 allow the attendant to make easy and accurate measurement of a user's liquid waste.

Additional advantages are provided by the secondary wing 9 and the corner 16. The secondary wing 9 and the corner 16 are curved upwards to prevent snagging of the bedpan 50 on bed sheets. Thus, the upward curvature of at least one of the secondary wing 9 and the corner 6 is advantageous because it allows unobstructed movement of the bedpan 50 when the bedpan 50 slides across a bed.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention, which is set forth in the following claims.

What is claimed is:

1. A bedpan for collecting waste comprising:

a main body for collecting liquid waste and solid waste, the main body including a seating area and two cavities formed within the seating area, the two cavities including a first cavity and a second cavity, the first cavity receiving the liquid waste and the second cavity receiving the solid waste; and a living hinge rotatably connected to the main body, the living hinge rotating between a closed position and an open position, the living hinge protecting a user from splashing in the closed position and allowing stacking of the bedpan in the open position, the living hinge comprising a top side that is concavely shaped to provide a comfortable seating arrangement when the living hinge is in the closed position, an indentation located near a central bottom portion of the living hinge, the indentation adapted for relieving pressure exerted against the tailbone of a user, a back end that is rounded for increased comfort to the user, and a curved portion that allows for a wider opening at a top surface of the curved portion than at a bottom edge of the curved portion when the living hinge is in the closed position.

2. The bedpan of claim 1, wherein the main body further includes one or more slits for receiving corresponding one or more locking elements, the one or more locking elements being located in the living hinge near an underside of the living hinge.

3. The bedpan of claim 2, wherein the one or more locking elements are selected from permanent snapping elements and temporary snapping elements.

4. The bedpan of claim 1, wherein the living hinge further comprises an inner edge that is curved downward to prevent the user from contacting any sharp edges.

5. The bedpan of claim 1, wherein the living hinge further comprises an underside shaped to accommodate a second living hinge of a second bedpan when the bedpan and the second bedpan are stacked.

* * * * *